US006283248B1

(12) United States Patent
Groover

(10) Patent No.: US 6,283,248 B1
(45) Date of Patent: Sep. 4, 2001

(54) COMPACT CLIMBING HARNESS

(76) Inventor: J. Steven Groover, 11625 Falconhill Dr., Whittier, CA (US) 90604

( * ) Notice: Subject to any disclaimer, the term of this patent is extended or adjusted under 35 U.S.C. 154(b) by 0 days.

(21) Appl. No.: 09/591,944

(22) Filed: Jun. 12, 2000

(51) Int. Cl.[7] ..... A62B 1/16
(52) U.S. Cl. ..... 182/6; 182/7
(58) Field of Search ..... 182/3–7

(56) References Cited

U.S. PATENT DOCUMENTS 1,642,911 9/1927 Thurnau .
3,757,893 * 9/1973 Hobbs ..... 182/6
4,632,217 12/1986 Markwell .
5,145,027 * 9/1992 Petzl ..... 182/3
5,615,750 * 4/1997 Phillips ..... 182/6

* cited by examiner

*Primary Examiner*—Alvin Chin-Shue
(74) *Attorney, Agent, or Firm*—Edgar W. Averill, Jr.

(57) ABSTRACT

A climbing harness for use with a belt worn around a user's waist for jointly supporting a load when climbing, and for compactly storing away when not in use. The climbing harness has a single-length strap configuration with a pair of strap ends and two slots located at a middle part of the harness. Each strap end is passed around one of the thighs of the user, and through one of the two slots, thereby creating two thigh loops. An interlaced portion, such as a knot, is formed at each slot for maintaining the size of the thigh loops, and each strap end is then preferably secured to the belt by a carabiner type clasp device.

14 Claims, 2 Drawing Sheets

COMPACT CLIMBING HARNESS

BACKGROUND OF THE INVENTION

The field of the invention pertains to climbing and rappeling harnesses. The invention relates more particularly to a climbing harness and system having a single-length strap for supporting a user along the upper thighs when climbing. Furthermore, the one-piece, single-length design of the strap allows the climbing harness to be stored away in a compact fashion.

Climbing harnesses are used in recreational and commercial activities, such as rock climbing or high-rise window washing, or for military and emergency service activities. In any case, these high-risk activities require the utmost degree of reliability and safety to prevent catastrophic injury.

Various climbing harness designs have been developed to provide simple, convenient, and facilitated use of the harness, without compromising the requirements of safety and reliability. In many situations, simple and quick engagement or release of the climbing harness is preferred to attain a particular objective, the most notable being a life-saving objective in emergency rescue situations. It is especially critical in rescue situations for the climbing harness to be capable of being donned and secured with great speed and simplicity to provide a more rapid response. However, due to their bulk and/or particular design configurations, existing climbing harness designs are not particularly well-suited to enable rapid donning and use.

For example, in U.S. Pat. No. 1,642,911, a belt is shown with a main support ring which functions as a hub. The main support ring supports two leg-supporting straps which are secured to the ring by detachable hooks. Furthermore, a central shackle functions to form two thigh support loops by permanently connecting to the main support ring. This device, however, does not provide adjustment of the thigh loops created which may compromise safety of the user. Furthermore, this device does not provide a compact harness design which can be easily disengaged and compactly stored away when not in use. In particular, the permanent attachment of the central shackle prevents complete disassociation of the two straps from the belt, which consequently prevents the straps from being compactly stored away separately from the belt.

Another seat-type climbing harness is shown in U.S. Pat. No. 5,145,027 comprising a pair of thigh loops, each having two strap ends which are permanently attached to a belt. The harness is lifted, i.e. a load applied, at a clasping device 18 which functions to join the respective inner strap ends of pair of thigh loops. While this climbing harness in the '027 patent enables adjustment of the thigh loops, unlike the '911 patent, by means of a retaining strip and a clamping buckle, the thigh loops are limited to a maximum allowable circumference. Moreover, this design requires a user to "step into" the pre-formed thigh loops in the harness, which under stressful conditions can be unduly awkward and cumbersome, and which can impede response time. Furthermore, and similar to the '911 patent, the permanently affixed configuration of the '027 climbing harness prevents compact storage separate from the belt.

In U.S. Pat. No. 5,615,750 another climbing harness is shown with a pair of buckles 58 and 60 which function to maintain a pair of leg loops at a desired circumference. In this arrangement, the leg loops are detachably connected to a belt portion by a centerpiece 46 which connects to a front portion of the belt via a belay loop 30, and by an elastic strap 62 which connects to a back portion of the belt via a haul loop 34. While it is possible to separate the thigh strap portion from the belt, it would be unduly cumbersome to release the strap ends 50, 52 from the buckles, especially when quick release is desired. Thus, Furthermore, and unlike the '911 and '027 patents, the centerpiece 46 operates alone at the front portion of the belt to support the thighs, without the strap ends 50, 52 separately attaching to the belt to provide an added measure of security.

Finally, in U.S. Pat. No. 4,632,217, another climbing harness is disclosed having a continuous length strap which is wrapped around the thighs and waist of a user. The climbing harness is wrapped around the user's thighs to form thigh loops, and wrapped around the waist to provide waist support. Furthermore, an additional restraining strap is utilized to provide additional support at the back portion of the thighs. This arrangement, however, prevents any separation of the waist support portion from the thigh support portion, which would be desirable especially when the belt portion is utilized and necessary for other purposes not related to the climbing harness, e.g. a multi-purpose utility belt.

In summary, therefore, it would be advantageous to provide a simple climbing harness capable of being rapidly, conveniently and easily secured and removed from a belt without compromising reliability and safety when in operation. And in particular, a climbing harness which overcomes the limitations and difficulties of climbing into pre-formed thigh loops would also increase the speed and efficiency of donning the harness. Furthermore, a climbing harness which is compactly storable when not in use would enable rapid access to the harness when needed, and shorten response time thereby.

BRIEF SUMMARY OF THE INVENTION

It is an object of the present invention to provide a simple, easy-to-use, one-piece design climbing harness for use with a belt to provide combined, rugged support when a load is applied thereon.

It is a further object of the present invention to provide a simple, easy-to-use, one-piece design climbing harness which may be rapidly donned by a user.

It is a still further object of the present invention to provide a single-length climbing harness which automatically configures to a user's morphology when being donned, without requiring separate adjustments.

It is a still further object of the present invention to provide a single-length climbing harness which is separable from the belt portion, and which may be compactly stored by rolling or folding the climbing harness when not in use.

The present invention is for a climbing harness (and system when combined with a waist belt) for use with a waist belt for jointly supporting a load when climbing. The waist belt has an anchoring component and the climbing harness has a single-length strap configuration which is capable of compact storage when not in use, The climbing harness has a pair of strap ends each having connector means for releasably connecting to the anchoring component, and a strap mid-section located between the pair of strap ends. Furthermore, the climbing harness also has a pair of slot means each defining a slot. And the pair of slot means is connected to the strap mid-section of the strap configuration and separated by an intermediate strap length. Additionally, the climbing harness has a pair of thigh loops each formed by passing a strap end through the slot of a corresponding slot means. Each thigh loop is maintained at a user-determined circumference by a knot formed by interlacing a tie section to a corresponding slot means.

DETAILED DESCRIPTION OF THE PREFERRED EMBODIMENTS

Figure 1:
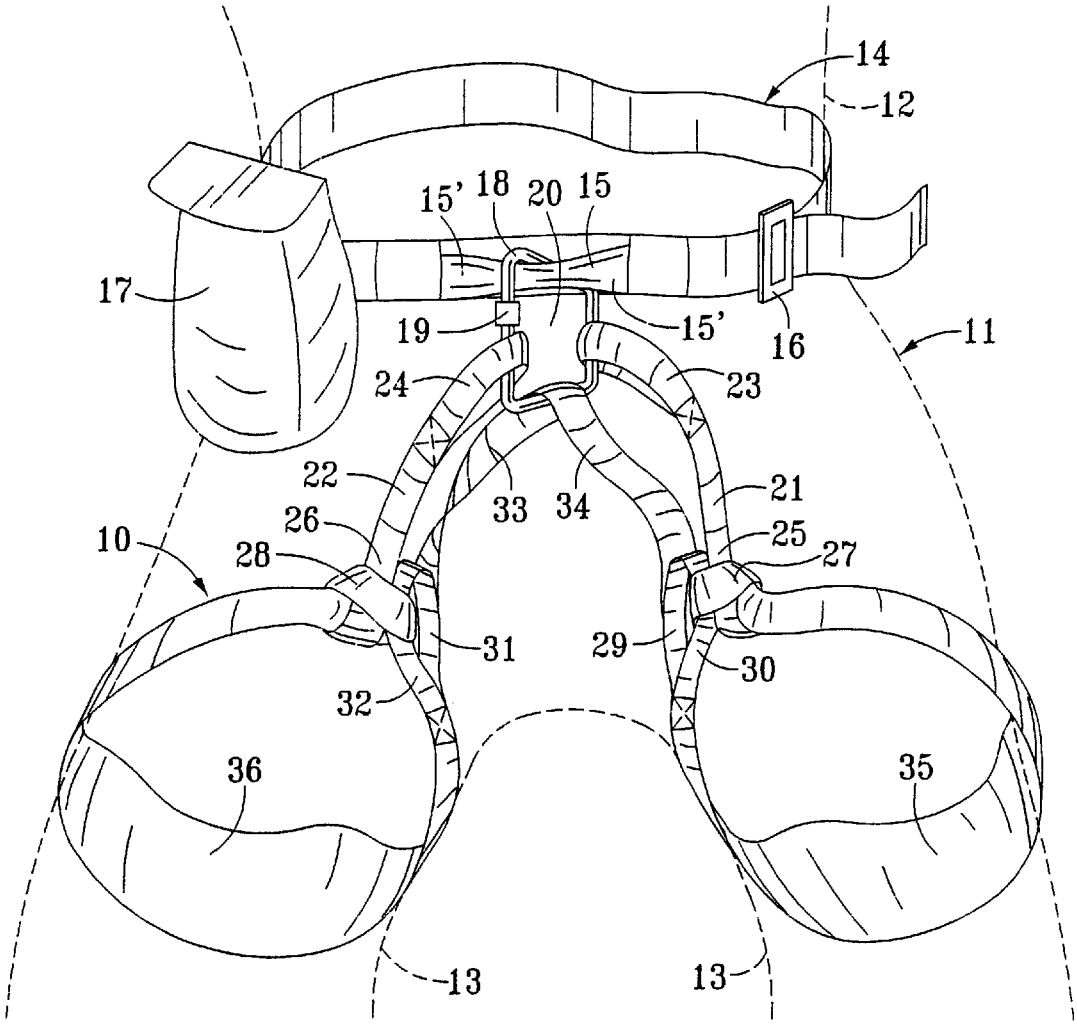
FIG. 1 is a front schematic view of the climbing harness as finally assembled on a user.

Referring now to the drawings, FIGS. 1–4B show the climbing harness, generally indicated at reference character 10, which is used in conjunction with a belt, generally indicated at reference character 14. Together, the climbing harness 10 and belt 14 comprise a climbing harness system when referenced as a combined unit. It is notable that the climbing harness 10 is not limited only for use in climbing. The term "climbing harness" is intended and used herein and in the claims to broadly refer to a harness usable for all activities and applications while suspended on a rope or chord. In particular, the climbing harness is also usable for rappeling, i.e. sliding down a rope.

FIG. 1 shows both the climbing harness 10 and belt 14 releasably secured and assembled on a user, generally indicated by broken lines at reference character 11. The climbing harness 10 is releasably secured to the upper thighs 13 of the user 10 in a manner discussed in detail below, and the belt 14 is releasably secured around the user's waist 12. The belt 14 is preferably of a type particularly suited and designed for rugged climbing, e.g. composed of durable fabric webbing (see discussion below). The belt 14 preferably has a load supporting element 15 which is preferably located at the front of the belt 14. Preferably still, the load supporting element 15 has opposite ends 15' which are secured to the belt 14 and form a gap therebetween. The belt 14 also has an anchoring component 18 which enables anchoring of the climbing harness 10 to the belt 14. As shown in the figures, the anchoring element 18 is preferably releasably secured to the load supporting element 15 (see greater discussion below). It is notable however, that belts not particularly suited for climbing, such as ordinary leather belts worn for style and fashion, may also be used in conjunction with the climbing harness 10 for limited emergency use. In any case, as shown in FIG. 1, the belt 14 typically utilizes a buckle 16 for adjusting the length of the belt 14 around the user's waist 12. Furthermore, the belt 14 preferably supports a pouch 17 or other container for compactly storing away and transporting the climbing harness 10 when not in use (see discussion below).

Figure 2:
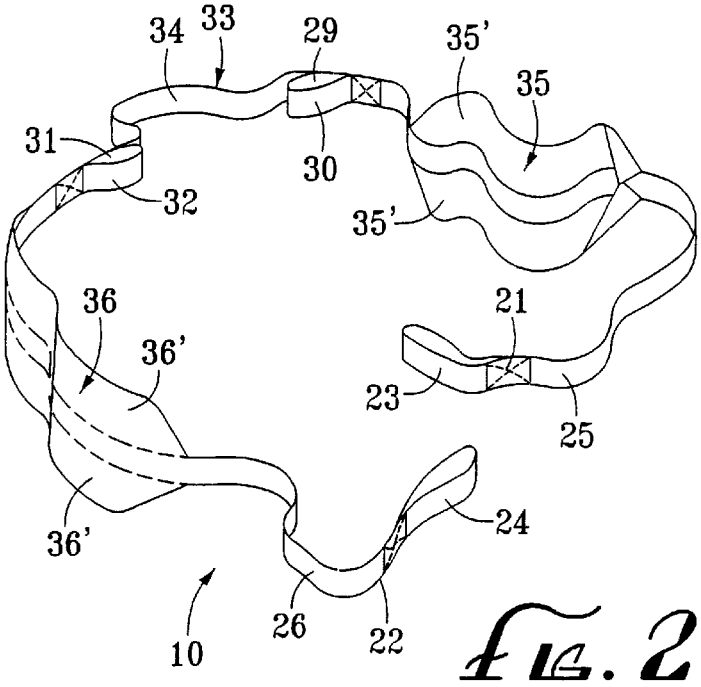
FIG. 2 is a perspective view of the climbing harness unraveled to illustrate the flexibility of the strap.
Figure 3:
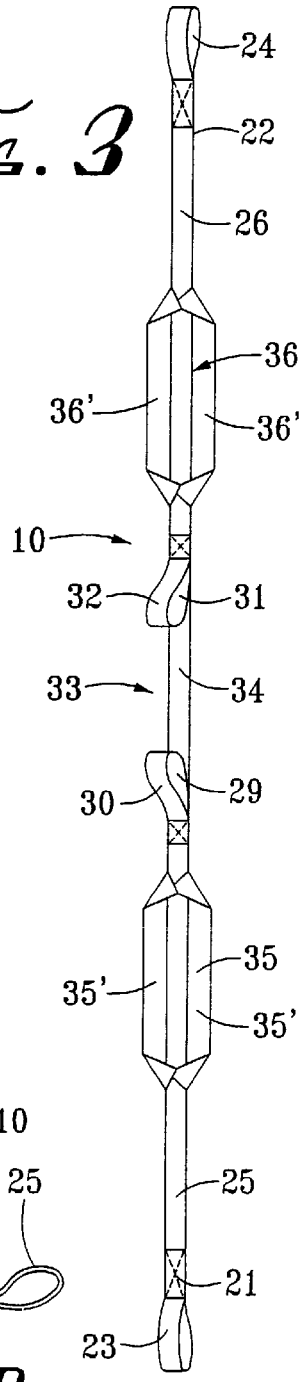
FIG. 3 is a perspective view of the climbing harness fully extended end to end to illustrate its complete length.

As can be best seen in FIGS. 2 and 3, the climbing harness 10 has an elongated, single-length strap configuration, preferably made of fabric webbing which provides strength and durability sufficient to support extreme loads. The climbing harness 10 has two strap ends 21, 22, with each strap end 21, 22 having connector means for releasably connecting to the anchoring component 18 of the waist belt 14. And preferably, each strap end 21, 22 has an end loop 23, 24 formed from the webbing of the strap ends 21, 22. Thus, the connector means of each strap end 21, 22 is the end loop 23, 24 which may releasably loop-connect to the anchoring component 18. A stitching process known in the relevant art is preferably used to ensure its ability to sufficiently withstand typical loads for various applications. Furthermore, adjacent each strap end 21, 22 is a corresponding tie section 25, 26, which is located between the strap mid-section 33 and a corresponding strap end 21, 22. As can be seen in the figures, the tie sections 24, 25 are considered to be located at penultimate positions with respect to the ultimate end locations of the pair of strap ends 21, 22.

Additionally, the climbing harness 10 has a pair of slots 29, 31, which are positioned at a mid-section 33 of the single-length strap configuration, and separated by an intermediate strap length 34. Each slot 29, 31 is preferably defined by an intermediate loop 30, 32 formed from the mid-section 33 of the single-length strap configuration. Furthermore, the intermediate loops 30, 32 are formed with the stitched portions to the outside of the slots 29, 31, i.e. closer to the strap ends 21, 22. As can be seen in FIG. 3, the intermediate strap length 34 is preferably a central segment of the climbing harness 10.

As can be best seen in FIGS. 2 and 3, the climbing harness 10 has a pair of thighs support sections 35, 36 positioned between the strap mid-section 33 and a corresponding tie section 25, 26. In particular, thigh support section 35 is positioned between the strap mid-section 33 and the tie section 25, and thigh support section 36 is positioned between the strap mid-section 33 and the tie section 26. Each thigh support section 35, 36 has a thigh support surface which has a wider area than other portions of the climbing harness 10 due to surface extensions 35' and 36' respectively, which transversely coextend from the strap body. This provides greater support and comfort for the user 11 when configured for support as shown in FIG. 1.

As shown in FIG. 1, illustrating the climbing harness 10 fully assembled on the user 11, the climbing harness 10 has a pair of thigh loops 37, 38 formed by passing each strap end 21, 22 around a corresponding thigh 13, and through a corresponding slot 29, 31. It is notable that while the strap ends 21, 22 are shown passed around the back of the corresponding thigh 13 from the inner crotch area to the outer portion, they may alternatively be passed around the respective thighs from the outer portion to the inner crotch area. In any case, the thigh loops 37, 38 are maintained at a desired, comfortable user-determined circumference by interlaced portions 27, 28, which are formed by interlacing the tie sections 25, 26 of corresponding strap ends 21, 22 to the corresponding intermediate loops 30, 32 via the slots 29, 31 at the front of the user 12. The tie sections 25, 26 comprise sections of the climbing harness 10 which are located closer to the center of the climbing harness 10 than the corresponding end loops 23, 24, whereby the end loops 23, 24 may sufficiently extend toward the load supporting element 15 of the belt 14 beyond the interlaced portions 27, 28.

Preferably, as shown in the figures, the interlaced portions 27, 28 are knots 27, 28 formed by tying the tie sections 25, 26 to the corresponding intermediate loops 30, 32. Furthermore, the knots 27, 28 are preferably simple knots, such as an overhand knot, which can be easily undone when disengaging the climbing harness 10 from the user 11. In this regard, it is notable that the knots 27, 28 need not be tightly formed to function properly in supporting the thighs 13. A loosely formed knot would effectively and sufficiently constrict under load conditions to provide support, while maintaining sufficient play to be easily released and undone. Alternatively, however, the interlaced portions 27, 28 may be formed by passing the strap ends 21, 22 several times through the corresponding slots 29, 31 in a weaving fashion to constrict the tie sections 25, 26 around the slots 29, 31 when pulled. It is further notable that the thigh loops 37, 38 do not have a preset circumference like the '911 patent or the preset maximum circumference like the '027 patent. Rather the circumference of the thigh loops 37, 38 are capable of adjusting to the exact thigh measurements of the user 11.

Each end loop 23, 24 of the strap ends 21, 22 is then releasably secured to the anchoring component 18 whereby the climbing harness 10 is releasably connected to the belt 14. Preferably, the anchoring component 18 is releasably secured to the load supporting element 15. It is notable that the anchoring component is preferably a clasp device. Moreover, the clasp device is preferably a carabiner 18, which is a device typically made of steel or other durable, load-bearing material and typically having a D-shaped ring configuration and conventionally used for various recreational, commercial, and emergency applications. As can be seen in FIG. 1, the carabiner 18 has a gate-lock mechanism 19 which enables the loop-connected end loops 23, 24 to pass through or be released from the carabiner 18. As can also be seen in FIG. 1, the strap mid-section 33 corresponding to the intermediate strap length 34 is preferably also releasably secured to the belt 14 by the releasably securing means, i.e. the carabiner 18.

In this manner, the climbing harness 10 and belt 14 jointly support a load experienced by the user 11 when climbing. Because the load is typically applied on the load-supporting element 15, the end loops 23, 24 connected to the load-supporting element 15 by way of the carabiner 18 function to distribute a portion of the load to the upper thighs 13 as well, and not only on the waist 12 of the user 11. Moreover, where the strap mid-section 33 of the intermediate strap length 34 also passes through and is releasably secured to the carabiner 18, as is generally preferred, the load distributed to the thighs 13 is supplementarily carried by the intermediate strap length 34. Moreover, by releasably securing the strap mid-section 33 corresponding to the intermediate strap length 34 to the carabiner 18, an additional measure of safety is provided should one or both of the end loops 23, 24 fail. It is notable that the load is typically the weight of the user 11 at the end of a climbing rope (not shown), including the user's gear. Moreover, the load may also include the weight of a second user/climber who is climbing in tandem, i.e. connected to the first user by a connector rope. It is notable that while the climbing harness 10 is discussed in reference to climbing, such as recreational rock or mounting climbing, it is not limited only to such. The climbing harness 10 may also be used for commercial uses, such as window cleaning, or emergency rescue situations or military operations as commonly experienced by firefighters, police, Coast Guard, etc.

Figure 4A:
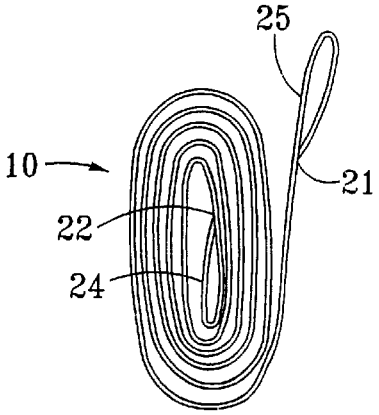
FIG. 4A is a side view of the climbing harness in a compact rolled configuration for storage.
Figure 4B:
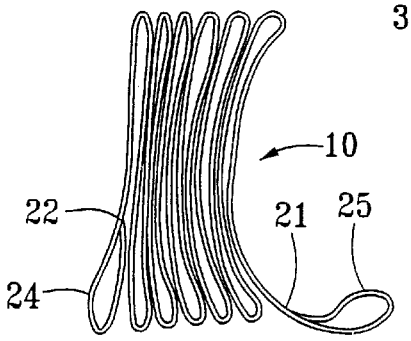
FIG. 4B is a side view of the climbing harness in a compact folded configuration for storage.

The single-length strap configuration of the climbing harness 10, combined with its ability to easily detach from the belt 14, enables the climbing harness 10 to be compactly and easily stored away when not in use. FIGS. 4A and 4B illustrate two examples of compacting methods which may be utilized for compact storage of the climbing harness 10. FIG. 4A shows the climbing harness 10 concentrically rolled into a ball type configuration. FIG. 4B shows the climbing harness 10 multiply folded into numerous strap layers. In any case, the resulting compact configuration is sufficiently small and compact to fit into the pouch 17 shown in FIG. 1, whereby it is easily accessible to the user 11 when not in use.

As noted for the composition of the belt 14, the climbing harness 10 is also preferably composed of a fabric webbing. The term "webbing," as used herein and in the claims, is intended to define any flat, elongated material exhibiting outstanding strength properties with minimal elongation. Additionally, all webbings described herein and in the claims, are preferably made of a polyester fabric material.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A climbing harness for use with a waist belt for jointly supporting a load when climbing, the waist belt having an anchoring component and the climbing harness having a single-length strap configuration capable of compact storage when not in use, said climbing harness comprising:

a pair of strap ends, each having connector means for releasably connecting to the anchoring component;

a strap mid-section located between the pair of strap ends;

a pair of slot means each defining a slot, with the pair of slot means connected to the strap mid-section and separated by an intermediate strap length;

a pair of tie sections each located between the strap mid-section and a corresponding strap end;

a pair of thigh loops each formed by passing a strap end through the slot of a corresponding slot means; and a pair of knots each formed by releaseably interlacing a tie section to a corresponding slot means, for maintaining user-determined circumferences of the pair of thigh loops until released by the user.

2. The climbing harness as in claim 1, wherein the pair of slot means are each an intermediate loop integrally formed from the strap mid-section.

3. The climbing harness as in claim 1, wherein each connector means comprises an end loop formed at the respective strap end, each loop for releasably loop-connecting anchoring component.

4. The climbing harness as in claim 1, further comprising a pair of thigh support sections, each thigh support section having surface extensions for increasing surface contact to said user's thighs and positioned between the strap mid-section and a corresponding tie section.

5. The climbing harness as in claim 1, wherein said climbing harness is composed of fabric webbing.

6. A climbing harness system for supporting a load when climbing, said climbing harness system comprising:

a waist belt having an anchoring component; and a single-length thigh strap for use with said waist belt and capable of compact storage when not in use, the thigh strap having:

a pair of strap ends each having connector means for releasably connecting to the anchoring component, a strap mid-section between the pair of strap ends, a pair of slot means each defining a slot, with the pair of slot means connected to the strap mid-section and separated by an intermediate strap length;

a pair of tie sections each located between the strap mid-section and a corresponding strap end, a pair of thigh loops each formed by passing a strap end through the slot of a corresponding slot means, and a pair of knots each formed by releaseably interlacing a tie section to a corresponding slot means for maintaining user-determined circumferences of the pair of thigh loops until released by the user.

7. The climbing harness system as in claim 6, wherein said waist belt has a load-support element, with the anchoring component releasably secured to the load-support element.

8. The climbing harness as in claim 6, wherein the strap mid-section corresponding to the intermediate strap length is releasably secured to the anchoring component.

9. The climbing harness system as in claim 6, wherein the pair of slot means are each an intermediate loop integrally formed from the strap mid-section.

10. The climbing harness system as in claim 6, wherein each connector means comprises an end loop formed at the respective strap end, each end loop for releasably loop-connecting anchoring component.

11. The climbing harness system as in claim 6, wherein the anchoring component is a releasably clasping device.

12. The climbing harness system as in claim 11, wherein the releasably clasping device is a carabiner.

13. The climbing harness as in claim 6, further comprising a pair of thigh support sections, each thigh support section having surface extensions for increasing surface contact to said user's thighs and positioned between the strap mid-section and a corresponding tie section.

14. The climbing harness system as in claim 6, wherein said belt and said thigh strap are composed of fabric webbing.

* * * * *